US006860318B2

(12) United States Patent
Tahitu et al.

(10) Patent No.: US 6,860,318 B2
(45) Date of Patent: Mar. 1, 2005

(54) APPARATUS AND METHOD FOR THE CONTINUOUS OR SEMI-CONTINUOUS CASTING OF ALUMINIUM

(75) Inventors: Gabriël Julius Raoul Tahitu, Voorhout (NL); Jean Pierre André Westerveld, Santpoort-Zuid (NL)

(73) Assignee: Corus Technology BV, Ijmuiden (NL)

( * ) Notice: Subject to any disclaimer, the term of this patent is extended or adjusted under 35 U.S.C. 154(b) by 0 days.

(21) Appl. No.: 10/169,603

(22) PCT Filed: Jan. 3, 2001

(86) PCT No.: PCT/EP01/00069

§ 371 (c)(1),
(2), (4) Date: Oct. 8, 2002

(87) PCT Pub. No.: WO01/49433

PCT Pub. Date: Jul. 12, 2001

(65) Prior Publication Data

US 2003/0111207 A1 Jun. 19, 2003

(30) Foreign Application Priority Data

Jan. 6, 2000 (NL) ..... 1014024

(51) Int. Cl.[7] ..... B22D 11/10

(52) U.S. Cl. ..... 164/488; 164/437; 164/489; 222/595

(58) Field of Search ..... 164/437, 438, 164/439, 488, 489; 222/595, 603

(56) References Cited

U.S. PATENT DOCUMENTS 3,718,175 A 2/1973 Rinesch
4,005,743 A * 2/1977 Ueda ..... 164/489
4,166,495 A * 9/1979 Yu ..... 164/486
4,668,288 A 5/1987 Ouchi et al.
4,852,633 A * 8/1989 Teshima et al. ..... 164/437
5,490,554 A * 2/1996 Moritz ..... 164/437
5,501,430 A * 3/1996 Yamaoka et al. ..... 266/236
6,276,437 B1 * 8/2001 Den Hartog ..... 164/488

FOREIGN PATENT DOCUMENTS

| | | |
|---|---|---|
| DE | 2017469 | 10/1970 |
| DE | 4403049 | 9/1995 |
| FR | 2675411 | 10/1992 |
| JP | 58035051 | 3/1983 |
| NL | 1001976 | 8/1997 |
| WO | 9723319 | 7/1997 |

OTHER PUBLICATIONS

Patent Abstract of Japan, May 20, 1983, vol. 007, No. 116–(M–216).

* cited by examiner

*Primary Examiner*—Kuang Y. Lin
(74) *Attorney, Agent, or Firm*—Stevens, Davis, Miller & Mosher, LLP

(57) ABSTRACT

Apparatus for the continuous or semi-continuous casting of molten aluminium to form an ingot in the mould (8) of a casting machine, including a launder (4), a casting mould and feed means (2) which is coupled to the launder and extends into the casting mould. The feed means is connected to the underside of a tundish (3), and the tundish is provided with an inlet member (10) for admitting molten aluminium from the launder (4) into the tundish. The tundish is also provided with pressure-reducing means (5) for lowering the absolute gas pressure in the part of the tundish which is above the molten aluminium admitted into the tundish.

25 Claims, 1 Drawing Sheet

APPARATUS AND METHOD FOR THE CONTINUOUS OR SEMI-CONTINUOUS CASTING OF ALUMINIUM

BACKGROUND OF THE INVENTION

The invention relates to an apparatus for the continuous or semi-continuous casting of molten aluminium to form an ingot in the mould of a casting machine, the apparatus comprising a launder, a casting mould and feed means which are coupled to the launder and extend into the casting mould. The invention also relates to a method for the continuous or semi-continuous casting of molten aluminium to form ingots from a launder by using feed means which are coupled to the feed trough and extend into a casting mould.

It should be noted that where the present patent application refers to ingots, this term is also intended to include billets (which have an essentially round cross sectional area) or other forms of castings.

An apparatus for casting aluminium ingots which is in widely used on an industrial scale uses two metal levels and comprises a launder or a transfer ladle positioned at a higher level than the casting mould or series of casting moulds beneath it. Apparatus of this type include, without any restriction being made, apparatus for the direct chill casting (DC) process and the electromagnetic casting (EMC) process. Molten aluminium is transferred from a casting furnace, via the launder into the casting mould by means of feed means, such as a spout, an immersion pipe or a casting nozzle, said feed means being coupled to the launder and often forming an exit port in the bottom or base of the launder. The casting nozzle exits below the meniscus of the molten aluminium into the casting mould. The exit or outlet opening of the casting nozzle is generally situated approximately 20 to 60 mm below said meniscus. To enable the flow of the aluminium out of the casting nozzle into the casting mould to be controlled to some extent in terms of direction and velocity, and therefore also to allow the ultimate macro-segregation profile in the cast ingot to be controlled, it is customary for a bag made from a glass-fibre material to be situated beneath the outlet opening.

A drawback of using a such a glass-fibre bag is that an individual cast is generally difficult to reproduce. Another drawback is that oxides may adhere to the glass-fibre material during casting, and at irregular intervals become detached from this material, thus having an adverse effect on the quality of the ingot. Another drawback is that in the start-up phase of a casting operation there may be an accumulation of large quantities of oxides in the glass fibre bag, which oxides then, during casting, may enter into the cast ingot and consequently have an adverse effect on the quality of the ingot.

An object of the invention is to provide an improved apparatus which does not have the above mentioned drawbacks, or at least has these drawbacks to a much lesser extent.

Another object of the invention is to provide a method for casting aluminium ingots which does not have the above mentioned drawbacks or at least has these drawbacks to a much lesser extent.

SUMMARY OF THE INVENTION

In one aspect of the invention there is provided an apparatus characterized in that the feed means are connected to a tundish, which tundish is provided with an inlet member for admitting molten aluminium from the launder into the chamber of the tundish and further with pressure-reducing means for lowering the absolute gas pressure in that part of the tundish which is above the liquid aluminium admitted into the chamber of the tundish.

The use of a tundish in a casting machine of this type for the continuous or semi-continuous casting of an aluminium ingot means that the flow velocity of the molten aluminium into the casting mould can be controlled much more successfully by means of the gas pressure and therefore, a macro-segregation profile which is much more reproducible and flatter is being obtained in the resultant ingot. Furthermore, the use of the known glass-fibre material bag is no longer required, and consequently all the associated drawbacks have been overcome. Furthermore, the reduced gas pressure in that part of the tundish which lies above the molten aluminium admitted into the tundish, being in the chamber of the tundish, achieves the effect that the formation of a whirlpool or vortex in the direct vicinity of the transfer area from the tundish to the feed means, such as a casting nozzle, being considerably reduced. A further advantage is a much more stable and less fluctuating meniscus in the casting mould.

An embodiment of the apparatus according to the invention is characterized in that the pressure-reducing means produce an absolute gas pressure in a range from 0.50 to 0.97 bar in that part of the tundish which lies above the liquid aluminium admitted into the chamber of the tundish. This corresponds to an absolute pressure difference with respect to atmospheric pressure of from 0.50 to 0.03 bar. Even a relatively small absolute pressure difference results in a considerable improvement in the control of the fluid flow velocity of the aluminium into the casting mould.

A preferred embodiment of the apparatus according to the invention is characterized in that the pressure-reducing means produce an absolute gas pressure in a range from 0.75 to 0.95 bar in that part of the tundish which lies above the liquid aluminium admitted into the chamber of the tundish. This corresponds to an absolute pressure difference with respect to atmospheric pressure of from 0.25 to 0.05 bar. This leads to a further improvement in the control of the fluid flow velocity of the aluminium into the casting mould.

It has been found that, when casting aluminium alloys which comprise alloying elements with a lower vapour pressure than molten aluminium at a given temperature, such as for example magnesium, when using the apparatus according to the invention there are no significant problems with the slightly reduced atmospheric pressure in the tundish. It is possible that due to the reduced gas pressure some degassing of the molten aluminium occurs, but this degassing is not the objective of the present invention.

An embodiment of the apparatus according to the invention is characterized in that the feed means comprise a casting nozzle which is formed in such a way that the flow pattern of the aluminium into the casting mould is substantially stable and symmetrical. The invention is partly based on the insight that a tundish comprising a chamber with a reduced gas pressure offers the possibility of moving away from the known casting nozzles or spouts, together with the associated drawbacks, and allows for the selection a casting nozzle which is much more suitable for imposing and maintaining a desired fluid flow pattern in the casting mould. The desired flow pattern may relate to both the symmetry, the stability, the outlet velocity, the outlet direction and suitable or desired combinations thereof.

An embodiment of the apparatus according to the invention is characterized in that the total cross-sectional outlet area of the casting nozzle, $A_{castingnozzle}$, divided by the horizontal cross-sectional area of the casting mould (which essentially corresponds to the thickness multiplied by the width of the aluminium ingot), $A_{castingmould}$, lies in a range from 0.0001 to 0.1, and preferably lies in a range from 0.001 to 0.1. The dimensionless loss-coefficient related to the mean velocity of the molten aluminium in the cross-sectional outlet area of the casting nozzle typically lies in a range less than $1.6 \cdot 10^6$, and preferably in a range of less than 10.

Depending on the width of the ingot to be cast, it is also possible for two or more casting nozzles to open out into one casting mould.

An embodiment of the apparatus according to the invention is characterized in that the outlet opening of the feed means, preferably a casting nozzle, lies in a range of more than 20 mm below the meniscus of the molten aluminium in the casting mould, preferably in a range of not more than 150 mm, and more preferably in a range of 40 to 70 mm.

It has been found that the apparatus according to the invention is particularly suitable for casting substantially rectangular ingots with a thickness and a width, the thickness being larger than 450 mm and preferably greater than 500 mm.

It has been found that the apparatus according to the invention is particularly suitable for casting substantially rectangular ingots with a thickness and a width, the width being larger than 2000 mm, preferably larger than 2300 mm, and more preferably larger than 2500 mm.

Aluminium ingots with a cross section of 450 by 2300 mm or greater are often referred to in the art as "jumbo" ingots. Ingots of this size are very difficult to cast continuously or semi-continuously and often have a macro-segregation profile which is difficult to reproduce and is highly unfavourable. Producing very large ingots of this dimension with the aid of the apparatus according to the present invention leads to considerable advantages, in particular a favourable macro-segregation profile and a more controllable flow of the molten aluminium into the casting mould.

In a further aspect of the invention there is provided a method for the casting of molten aluminium to form an ingot in the mould of a casting machine, comprising the steps of casting molten aluminium via a launder and by using feed means which are coupled to said launder and extend into said casting mould, characterized in that the feed means are connected to a tundish, which tundish is provided with an inlet member for admitting molten aluminium from the launder to the tundish and maintaining the absolute gas pressure in that part of the tundish which lies above the liquid aluminium which has been admitted with pressure-reducing means.

When using the method according to the invention for the continuous or semi-continuous casting of an aluminium ingot, the fluid flow velocity of the aluminium into the casting mould can be controlled much more successfully, and therefore, a macro-segregation profile which can be reproduced more successfully and is more favourable is obtained in the final cast ingot. Furthermore, it is no longer necessary to use a glass-fibre material bag, with the result that all the associated drawbacks are overcome. Furthermore, a reduced gas pressure in that part of the tundish which lies above the molten aluminium admitted means that the formation of a whirlpool or vortex in the direct vicinity of the transition area from the tundish to the feed means, such as a casting nozzle, is considerably reduced.

An embodiment of the method according to the invention is characterized in that an absolute gas pressure in a range from 0.50 to 0.97 bar is selected in that part of the tundish which lies above the liquid aluminium admitted into the tundish, and more particularly in that an absolute gas pressure in a range from 0.75 to 0.95 bar is selected in that part of the tundish which lies above the liquid aluminium admitted into the tundish. Even a relatively small absolute pressure difference results in a considerable improvement in the control of the fluid flow velocity of the aluminium into the casting mould. A further advantage and a preferred arrangement is that the stopper rod, as a control member, no longer has to be located directly above or in alignment with the casting nozzle. As a result, disruption caused by a stopper rod no longer affects the fluid flow pattern of an immersion pipe or casting nozzle. Furthermore, this achieves the effect of a desirable and more stable, uniform and symmetrical inlet fluid flow.

In a further embodiment of the method according to the invention, the method is characterized in that the aluminium is cast so as to form a substantially rectangular ingot with a thickness of 450 mm or more, and more preferably of 500 mm or more, and furthermore in that the aluminium is cast so as to form a substantially rectangular ingot with a width of 2000 mm or more, preferably more than 2300 mm, and more preferably 2500 mm or more.

Aluminium ingots with a cross-sectional area of 450 by 2000 mm or larger are often referred to in the art as "jumbo" ingots. Large ingots of this type are very difficult to cast continuously or semi-continuously and often have a macro-segregation profile which is difficult to reproduce and unfavourable. Manufacturing large ingots of this dimension by means of the method according to the invention leads to considerable advantages, in particular a much more favourable macro-segregation profile as a result of more successful control of the fluid flow of the aluminium into the casting mould.

It has also been found that the method and apparatus according to the invention have proven particularly suitable for the production of ingots from wrought aluminium alloys with a high content of alloying elements, in particular the aluminium alloys from the Aluminium Association (AA) 2xxx, the (AA)5xxx, and (AA)7xxx series, such as, but not limited thereto, 2024, 2034, 5053, 5069, 7010, 7050, 7075 and modifications thereof.

Furthermore, the invention relates to a casting nozzle for use in the apparatus according to the invention or for use in the method according to the invention, as described in more detail above and in the figures.

Furthermore, the invention relates to a tundish for use in the apparatus according to the invention or for use in the method according to the invention, as described in more detail above and in the figures.

BRIEF DESCRIPTION OF THE DRAWINGS

The invention will be described below with reference to the figures showing non-limiting exemplary embodiments. In the figures.

DETAILED DESCRIPTION OF THE INVENTION

Figure 1:
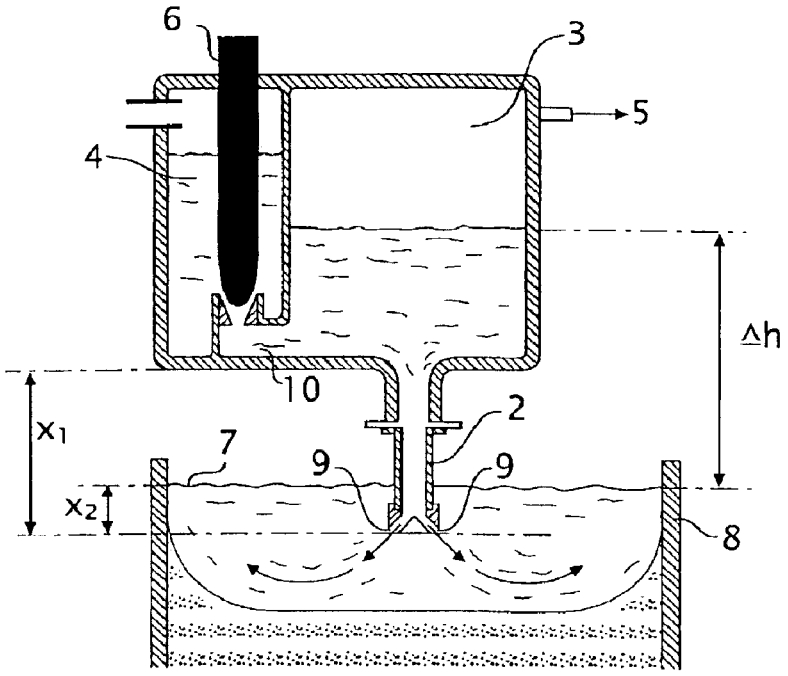
FIG. 1 shows a schematic view of a continuously or semi-continuously operating apparatus for producing an aluminium ingot using the invention.

FIG. 1 schematically shows an apparatus for the semi-continuous casting of an ingot 1, in which a tundish 3 is provided, connected to pressure-reducing means 5, such as a vacuum pump, for lowering the gas pressure in that part of the tundish 3 which lies above the molten aluminium admitted, and an inlet member 10 is also provided for admitting molten aluminium from a launder 4 into the tundish. Normal atmospheric pressure prevails in the launder 4. The inlet of molten aluminium can be regulated by means of a stopper rod 6. The regulating system for admitting molten aluminium can be of automated design. To regulate the molten aluminium flowing from the tundish 3 into the casting mould 8, it is not necessary for the stopper rod 6 to be situated directly above or in direct alignment with the feed means, said feed means being the casting nozzle. This arrangement is even preferred. The molten aluminium flows via feed means 2, such as a casting nozzle, which are connected to the tundish, into a casting mould 8. The feed means 2 extend to below the meniscus 7 of the molten aluminium in the casting mould. The distance $X_2$ between the meniscus 7 of the molten aluminium and the outlet opening 9 of the feed means 2 preferably lies in a range of less than 70 mm. This is particularly important when casting "jumbo" ingots. The distance $X_1$ between the bottom of the tundish 3 and the outlet opening 9 of the feed means 2 preferably lies in a range from 300 to 500 mm, and preferably in a range from 400 to 500 mm. The height difference $\Delta h$ between the fluid level in the tundish and the fluid level 7 in the casting mould typically lies in a range from 150 to 1500 mm, and preferably in a range from 150 to 1000 mm.

Figure 2A:
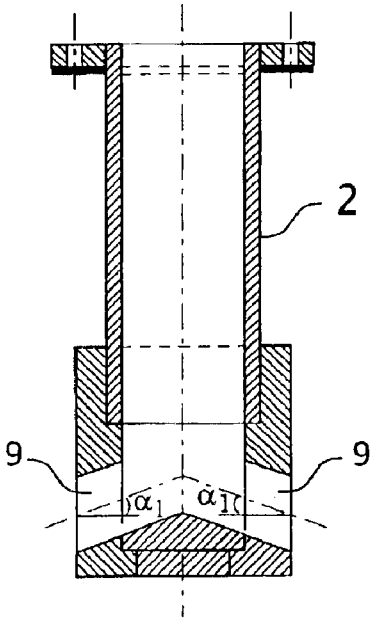
FIGS. 2*a* and 2*b* show a schematic cross-section through a casting nozzle for coupling to a tundish in an apparatus according to this invention.
Figure 2B:
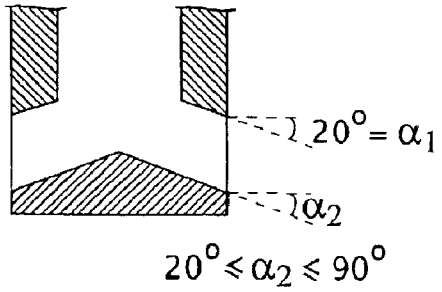

FIG. 2*a* schematically shows a casting nozzle 2 which has proven particularly suitable for use in combination with the tundish according to the invention. The casting nozzle comprises two symmetrical outlet openings 9 which are at an angle $\alpha_1$ with respect to a longitudinal axis, which longitudinal axis, in operation, forms the axis of suspension. In FIG. 2*a*, $\alpha_1$ is equal to 20° with respect to the horizontal and typically lies in a range from 10° to 90°. The casting nozzle is made from a suitable refractory material. The cross section of the casting nozzle may be in various forms, such as oval and round. The outlet openings may also be in various forms. In FIG. 2*b*, $\alpha_1$ is equal to 20° and, independently of this, $\alpha_2$ can be selected in a range from 10° to 90°, and preferably 20° to 90°.

Having now fully described the invention, it will be apparent to one of ordinary skill in the art that many changes and modifications can be made without departing from the spirit or scope of the invention as set forth by the claims appended hereto.

What is claimed is:

1. Apparatus for the semi-continuous casting of molten aluminium to form an ingot in the mould of a casting machine, the apparatus comprising:

a launder, a casting mould and feed means coupled to the launder and extends into the casting mould, wherein the feed means are connected to the underside of a tundish, the tundish is provided with an inlet member for admitting molten aluminium from the launder into the tundish, wherein a part of the tundish is located above the molten aluminium admitted into the tundish, and the tundish is provided with pressure-reducing means for lowering the absolute gas pressure in that part of the tundish located above the molten aluminium admitted into the tundish, and wherein the pressure-reducing means, during use, is able to produce an absolute gas pressure in a range from 0.50 to 0.97 bar in the part of the tundish located above the molten aluminium admitted into the tundish, and the casting mould has dimensions for casting an ingot with a thickness of 450 mm or more.

2. Apparatus according to claim 1, wherein the pressure-reducing means, during use, is able to produce an absolute gas pressure in a range from 0.75 to 0.95 bar in the part of the tundish located above the molten aluminium admitted into the tundish.

3. Apparatus according to claim 1, wherein the feed means comprises a casting nozzle formed in such a way that the fluid flow pattern of the molten aluminium into the casting mould is substantially stable and symmetrical.

4. Apparatus according to claim 3, wherein the total outlet area of the casting nozzle divided by the horizontal cross sectional area of the casting mould lies in a range from 0.0001 to 0.1.

5. Apparatus according to claim 1, for casting an ingot having a length, a width and a thickness, and wherein the casting mould has dimensions for casting an ingot with a width of 2000 mm or more.

6. Apparatus according to claim 3, wherein the total outlet area of the casting nozzle divided by the horizontal cross sectional area of casting the mould lies in a range from 0.001 to 0.1.

7. Apparatus according to claim 1, wherein the casting nozzle has a dimensionless loss-coefficient in a range of less than $1.6\times10^6$.

8. Apparatus according to claim 1, wherein the casting nozzle has a dimensionless loss-coefficient in a range of less than 10.

9. Apparatus according to claim 1, wherein the casting mould has dimensions for casting an ingot with a thickness of 500 mm or more.

10. Apparatus according to claim 1, wherein the casting mould has dimensions for casting an ingot with a width of 2300 mm or more.

11. Apparatus according to claim 1, wherein the casting mould has dimensions for casting an ingot with a width of 2500 mm or more.

12. Apparatus according to claim 5, wherein the casting mould has dimensions for casting an ingot with a thickness of 500 mm or more.

13. Apparatus according to claim 1, wherein the feed means comprises two or more casting nozzles formed in such a way that the fluid flow pattern of the molten aluminium into the casting mould is substantially stable and symmetrical.

14. Method for the semi-continuous casting of molten aluminium to form an ingot in the mould of a casting machine, comprising the steps of:

casting molten aluminium via a launder and by using feed means which is coupled to the launder and extends into a casting mould, admitting the molten aluminium to a tundish from the launder and passing the molten aluminium from the tundish through the feed means into the casting mold, lowering the absolute gas pressure by pressure-reducing means, above the molten aluminium admitted into the tundish, coupling an underside of the tundish to the feed means and the tundish with an inlet member for admitting the molten aluminium from the launder into the tundish, wherein a part of the tundish lies above the molten aluminium admitted into the tundish and in use, an absolute gas pressure in a range from 0.50 to 0.97 bar is applied in the part of the tundish which lies above the molten aluminium admitted into the tundish, and the aluminium, is cast into a substantially rectangular ingot having a thickness and a width, the thickness being 450 mm or more.

15. Method according to claim 14, wherein an absolute gas pressure in a range from 0.75 to 0.95 bar is applied in the part of the tundish which lies above the molten aluminium admitted into the tundish.

16. Method according to claim 14, wherein the aluminum is cast into a substantially rectangular ingot having a thickness and a width, the width being 2300 nm or more.

17. Method according to claim 14, wherein the aluminium, is cast into a substantially rectangular ingot having a thickness and a width, the thickness being 500 mm or more.

18. Method according to claim 14, wherein the aluminium is cast into a substantially rectangular ingot having a thickness and a width, the width being 2500 mm or more.

19. Method according to claim 14, wherein the outlet opening of the feed means is arranged to lie in between 20 mm and 150 mm below the meniscus of the molten aluminium in the casting mould.

20. Method according to claim 14, wherein the outlet opening of the feed means is arranged to lie in a range of 40 to 70 mm below the meniscus of the molten aluminium in the casting mould.

21. Method according to claim 14, wherein the inlet of molten aluminium from the launder to the tundish is regulated using a stopper rod, said stopper rod being arranged out of alignment with the feed means.

22. Method according to claim 14, wherein the aluminium alloy cast is selected from the group consisting of AA2xxx, AA5xxx and AA7xxx-series aluminium alloys.

23. Method according to claim 14, for casting an ingot having a length, a width and a thickness, and wherein the casting mould has dimensions for casting an ingot with a width of 2000 mm or more.

24. Method according to claim 14, wherein the casting mould has dimensions for casting an ingot with a width of 2300 mm or more.

25. Method according to claim 24, wherein the casting mould has dimensions for casting an ingot with a thickness of 500 mm or more.

* * * * *